United States Patent [19]

Ayers

[11] Patent Number: 4,775,000

[45] Date of Patent: Oct. 4, 1988

[54] CONTINUOUS CASTING OF TUBULAR SHAPES BY INCREMENTAL CENTRIFUGAL MATERIAL DEPOSITION

[76] Inventor: Jack D. Ayers, 3216 Dominy Ct., Oakton, Va. 22124

[21] Appl. No.: 900,803

[22] Filed: Aug. 27, 1986

[51] Int. Cl.[4] ..... B22D 11/04; B22D 11/10; B22D 13/02; B22D 13/08

[52] U.S. Cl. ..... 164/464; 164/415; 164/419; 164/421; 164/422; 164/437; 164/440; 164/460; 164/461; 164/464; 164/475; 164/476; 164/479; 164/488; 164/490

[58] Field of Search ..... 164/464, 461, 475, 479, 164/488, 490, 415, 419, 421, 422, 427, 437, 440, 46, 460, 476

[56] References Cited

U.S. PATENT DOCUMENTS

| | | | |
|---|---|---|---|
| 777,559 | 12/1904 | Stravs et al. | 164/464 |
| 777,562 | 12/1904 | Stravs et al. . | |
| 2,752,648 | 7/1956 | Robert | 164/464 X |
| 2,864,137 | 12/1958 | Brennan | 164/421 X |
| 3,583,469 | 6/1971 | Peytavin et al. | 164/464 |
| 3,605,859 | 9/1971 | Leghorn | 164/464 X |
| 3,616,842 | 11/1971 | Leghorn | 164/464 |
| 3,625,276 | 12/1971 | Considine et al. | 164/464 |
| 3,670,400 | 6/1972 | Singer | 164/461 X |
| 3,771,587 | 11/1973 | Poran | 164/422 X |
| 3,971,123 | 7/1976 | Olsson . | |
| 4,326,579 | 4/1982 | Pond et al. | 164/461 |
| 4,428,416 | 1/1984 | Shimanuki et al. | 164/461 |
| 4,512,384 | 4/1985 | Sendzimir | 164/464 X |
| 4,573,523 | 3/1986 | McCaffrey | 164/464 X |
| 4,688,621 | 8/1987 | Darmara | 164/464 X |

FOREIGN PATENT DOCUMENTS

| | | | |
|---|---|---|---|
| 511995 | 6/1976 | U.S.S.R. | 164/46 |
| 1517283 | 7/1978 | United Kingdom . | |

*Primary Examiner*—Nicholas P. Godici
*Assistant Examiner*—J. Reed Batten, Jr.
*Attorney, Agent, or Firm*—Stephen F. K. Yee

[57] ABSTRACT

An apparatus and process for the continuous casting of tubular shapes wherein molten metal from which the tubular shape is formed is centrifugally deposited adjacent to the outlet of a fluid-cooled mold by a nozzle assembly, with the metal being cooled and rapidly solidified by the mold to form a cylindrical shell upon which additional metal is deposited to incrementally build the thickness of the tubular shape. The tubular shape being formed is withdrawn continuously from the mold, and is further cooled by coolant directed thereon. The nozzle assembly may be rotated to discharge the molten metal or, alternatively, the mold may be rotated as the metal is deposited thereon. Single-layer tubular shapes, with or without reinforcing material, may be cast and multiple-layer composite shapes may be produced having layers of different material composition and thicknesses. An inert atmosphere is maintained to prevent oxidation of the molten metal. Tubular shapes cast may be longitudinally split and flattened to form sheet metal having desirable, refined microstructures.

38 Claims, 4 Drawing Sheets

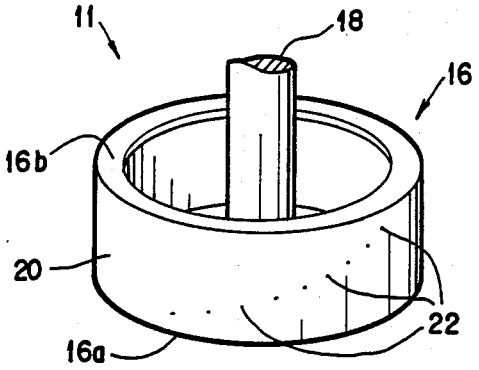
FIG.4a
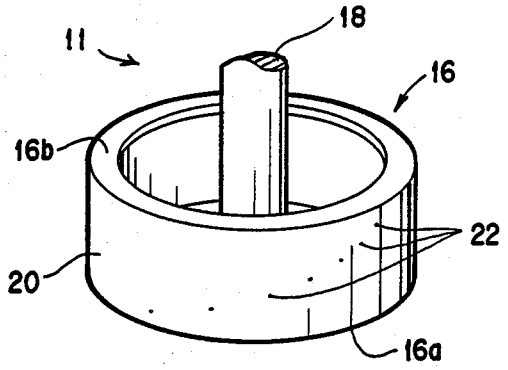
FIG.4b
FIG.4c
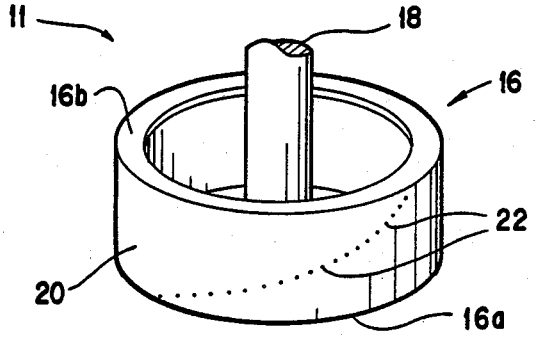
FIG.8
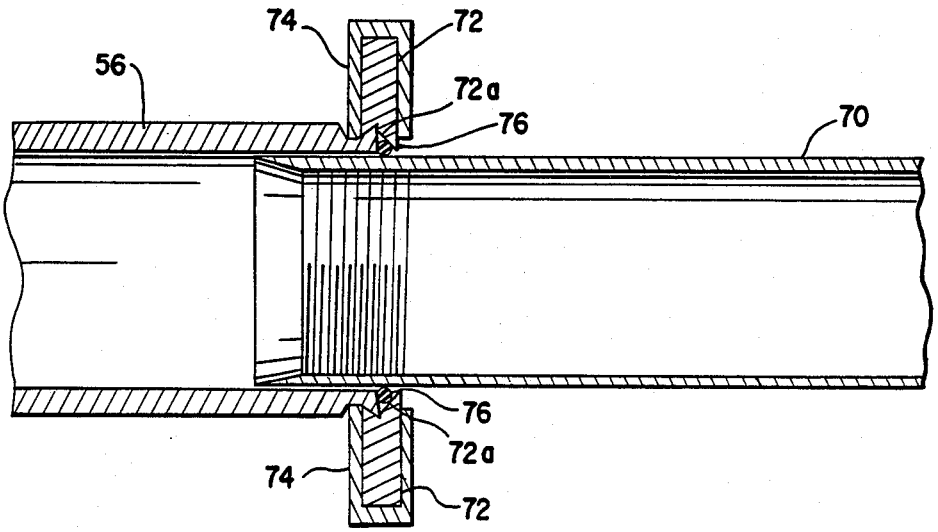

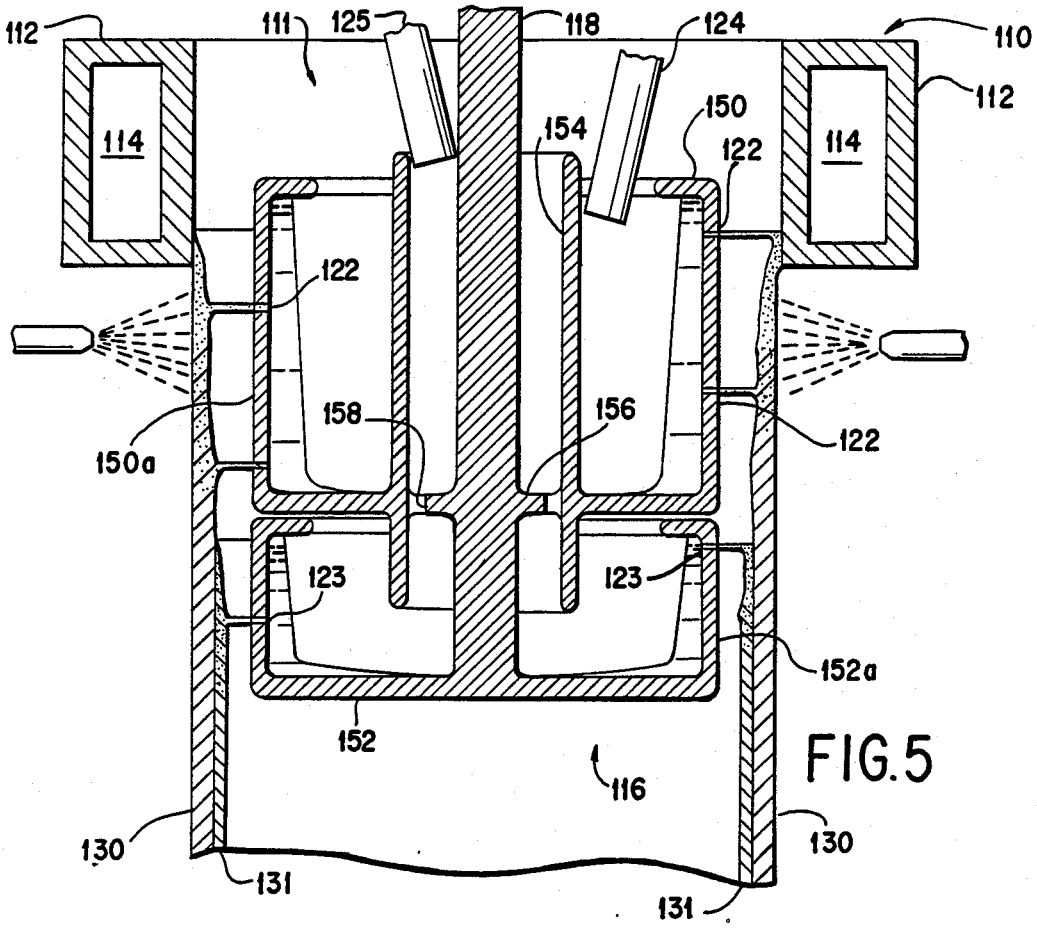
FIG.5
FIG.6
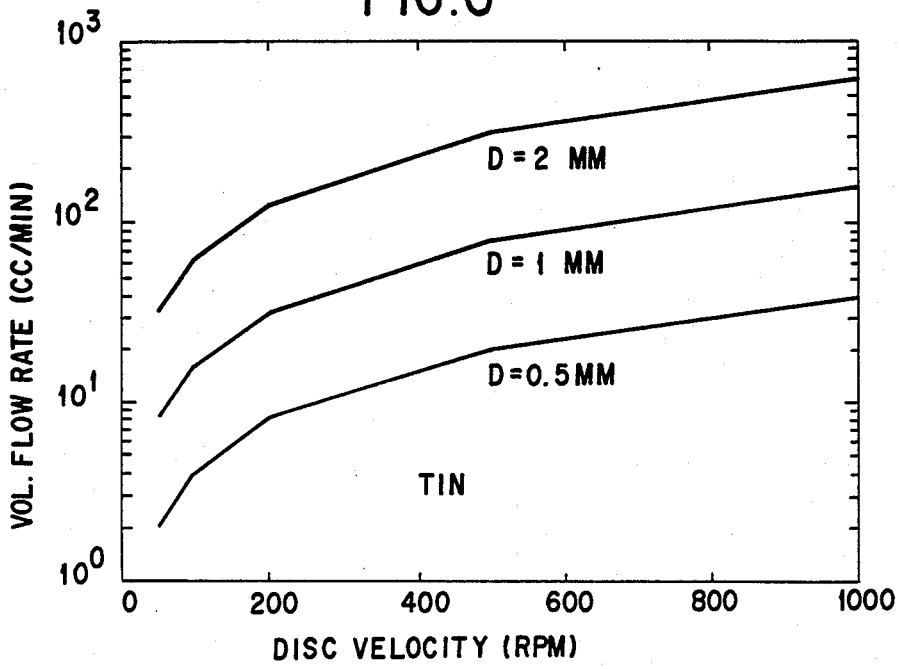

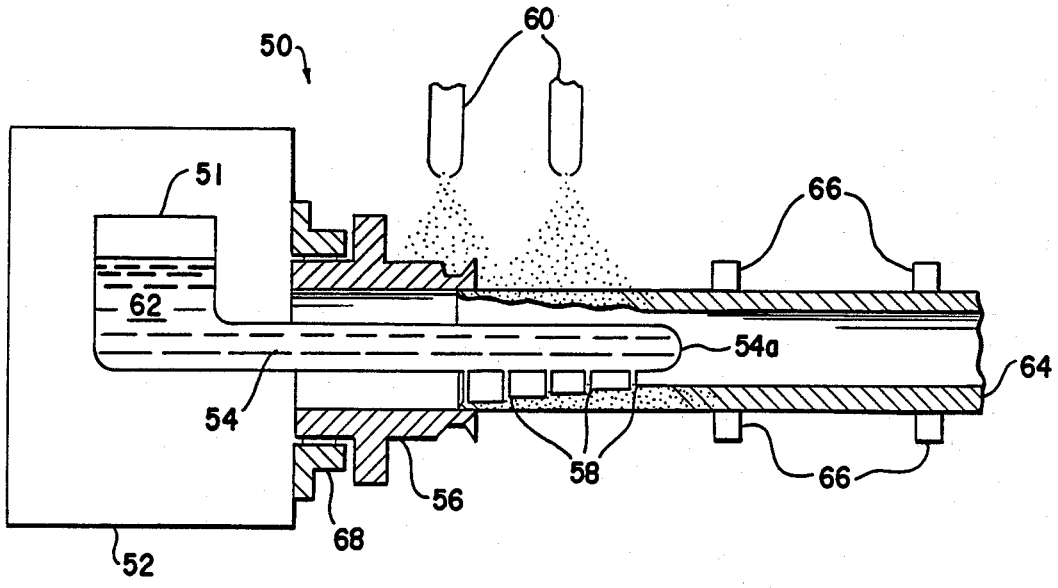
FIG.7
FIG.9
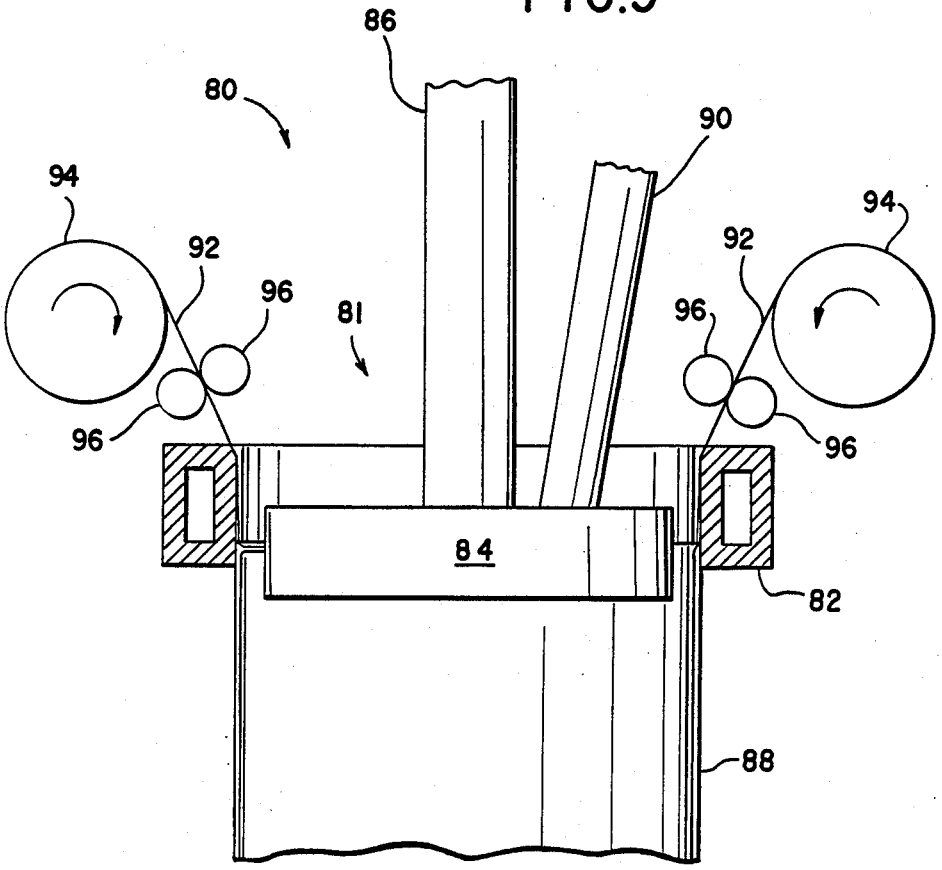

CONTINUOUS CASTING OF TUBULAR SHAPES BY INCREMENTAL CENTRIFUGAL MATERIAL DEPOSITION

BACKGROUND OF THE INVENTION

1. Field of the Invention

The invention relates to the continuous casting of tubular shapes, and is more particularly directed to the continuous casting of tubular shapes directly from the molten material using a fluid-cooled mold and centrifugal deposition of the material.

2. Prior Art

The advantages of producing tubular shapes of metals and alloys directly from the molten material by casting, rather than by shaping solid metals into tubular shapes, are so apparent that many techniques have been developed for casting these shapes. Of the many types of known tube casting processes, two general classes are of interest with respect to the present invention: the continuous centrifugal casting processes and the incremental deposition processes.

The continuous centrifugal casting processes achieve their objective by pouring liquid metal into a rotating mold which is externally cooled to remove the latent heat of fusion and so solidify the molten metal within the mold. These processes operate in a continuous manner by pulling the solidified tubular shape from the mold at a constant rate. The solidified tube or pipe may be rotated at the same speed as the mold or, for reasons discussed below, at a different speed. These processes generally provide for cooling of the tube after it exits from the mold since extraction of heat through the mold is inefficient and the tube is still very hot when it exits from the mold.

Examples of continuous centrifugal casting are disclosed in the following U.S. Pat. Nos.:

| Patent | Patentee |
|---|---|
| U.S. 2,752,648 | Robert |
| U.S. 3,605,859 | Leghorn |
| U.S. 3,616,842 | Leghorn |
| U.S. 3,771,587 | Poran |
| Brit. 15,912 | Lane et al. |
| Brit. 22,708 | Maxim et al. |

The success of tube formation by continuous centrifugal casting has been limited due to problems created by high friction between the mold and the solidifying tube. In all continuous casting processes these frictional forces cause problems because the solidifying metal must be kept in close contact with the mold to permit heat removal through the mold as the partially solidified strand is drawn from it. The problems created by this friction are particularly severe in the centrifugal processes because rotation of the tube at speeds high enough to hold the molten metal in the desired shape until it solidifies produces very high forces which press the tube into intimate contact with the mold.

Different solutions have been proposed to overcome this problem, with limited degrees of success. Such solutions have included the use of slippery mold linings or a layer of higher-density material as a continuous lubricating film (Maxim et al.); use of pressurized gas in combination with a continuous lubricating film (Leghorn); injection of hydrocarbon lubricants (Poran); and creation of relative motion, rotationally or axially, between the mold and the tube (Robert, Poran). Each proposed solution has its shortcomings. Thus, with these continuing problems, even after many years of development efforts the various continuous centrifugal casting processes are still not economically attractive operations.

The Maxim patent, which discloses the use of a continuous film of molten metal of greater density than the tube material, introduces the higher-density metal into the leading end of the mold, together with or close to the introduction of the tube-forming metal. The centrifugal force causes the two immiscible metals to partition, with the denser metal forming a continuous lubricating film on the inner surface of the mold. This approach is attractive in principle, but is of limited utility because of several shortcomings.

First, few immiscible metal pairs have the correct ratios of melting points and densities to make the process feasible, the only metals of real commercial potential being iron and some of its alloys, paired with lead. The process is further limited because the temperature of the lubricating metal must be kept above its melting point so that the efficiency of heat removal is very poor. Another problem of this process is that the lubricating metal must be continuously cycled through the system because it spills out the open end of the mold, again leading to process inefficiencies. Efforts to minimize this overflow by limiting the exit size of the mold led to startup problems because of the varying diameter of the tube during this stage.

The second general class of processes of interest to the present invention are those which employ incremental deposition techniques to build up a body of the desired thickness, and may be considered within two subclasses: those which build up thin ribbons or sheets of metal into a thicker layer, and those which spray deposit molten droplets onto a form to build up a deposit of the required thickness.

Processes in which thin ribbons or sheets are built up incrementally do not include processes which produce tubes, but their teachings relate to the present invention. These processes are recent developments, having been inspired by recent interest in rapid-solidification processing of metals. Examples of this art include U.S. Pat. Nos.:

| Patent | Patentee |
|---|---|
| U.S. 3,971,123 | Olsson |
| U.S. 4,326,579 | Pond et al. |
| U.S. 4,428,416 | Shimanuki et al. |

Due to problems associated with these techniques, principally related to thermal contraction, efforts to build up sheet materials by these types of incremental deposition processes have thus far failed to lead to the commercial production of rapidly-solidified strips more than a few thousandths of an inch thick.

The latter subclass of incremental deposition processes can produce thicker sheets as well as tubular shapes, but these processes also exhibit important limitations. Illustrative of the many endeavors in this area are U.S. Pat. Nos.:

| Patent | Patentee |
|---|---|
| U.S. 2,864,137 | Brennan |
| U.S. 3,670,400 | Singer |
| U.S. 4,512,384 | Sendzimir |

-continued

| Patent | Patentee |
|---|---|
| Brit. 1,517,283 | Singer |

The Singer patents describe several processes by which molten metal, atomized into droplets by a gas or by centrifugal means, is sprayed onto a cooled substrate to build up a bulk material, including the formation of tubes by spraying onto moving mandrels which must be removed after the tubes are formed and cut into sections the length of the mandrels, and the formation of large-diameter tubes by spraying the droplets radially outward onto the inner surface of a reciprocating cylindrical mold. The tubes must be subsequently hot-worked.

The most serious problem inherent to these spray deposition processes is that the deposits are inherently porous. This is true because when the molten metal droplets impact upon the cool substrate and upon the previously deposited metal they splash out into irregularly-shaped "splats" without completely wetting the perimeters of previously deposited droplets. These pores are very difficult to eliminate because atomized droplets exhibit a wide range of particle sizes, and droplets of different sizes freeze in different ways when they strike cool surfaces. This problem is generally dealt with by consolidating the deposits after they are formed, most often by hot rolling the product. This approach is undesirable because oxidation of the void surfaces or the presence of included gases often leads to problems in generating high integrity materials.

Attempts are sometimes made to minimize the formation of voids by adjusting the process conditions such that each new impacting droplet strikes the accruing surface just before the last deposited droplet solidifies so that the new droplet fully wets the surface and leaves no voids. This solution is not entirely satisfactory. A major shortcoming of this approach is that the rate of cooling diminishes as the deposit increases in thickness, with the result that it is difficult to control the process variables so as to continuously maintain a thin layer of liquid metal at the product surface. This problem is aggravated by the fact that the diverse atomization processes all produce particles of a wide range of sizes, and each of these sizes solidifies at a different rate. Because of this effect large particles will still be molten, perhaps having a temperature near the original superheat temperature, when they strike the product, while the finest particles will be fully solidified. This makes it very difficult to generate uniform, pore-free structures.

The decreasing rate of cooling during the buildup of thick layers has undesirable effects in addition to that of altering the nature of pore formation. The initially-deposited material, which cools most rapidly, has very fine microstructural features, with minimal partitioning of alloy constituents. The later-deposited material has coarser microstructural features, more segregation and, as a consequence, less desirable properties. Efforts made to overcome this problem include periodically interrupting the deposition process or by moving either the atomizer or the product in a reciprocating fashion, but these means are not fully satisfactory as they can lead to banded structures.

Further serious problems, associated with the degree of bonding between the spray deposit and the mold or substrate material upon which the metal is deposited, are not productively addressed in the above-cited patents. In order to achieve good heat transfer characteristics between the deposit and the substrate, it is desirable that the deposit be well bonded to the substrate. On the other hand, in order to separate the deposit easily when it has reached the required thickness, it is desirable that the bond be weak. As a consequence, compromises must be made, and these compromises generally lead to separation of the deposit before it has reached full thickness. Material deposited after the separation cools even more slowly. This problem is particularly acute in the continuous tube forming processes, in which the deposit can not be bent to separate it from the mold. Thus, when the deposited tube is being pulled from the mold, portions of it tend to stick and, because the hot and porous metal has little strength, these portions can break off and be left behind in the mold.

An important characteristic of atomized metal sprays contributes to this last-mentioned problem. Virtually all atomized sprays spread out in directions normal to their nominal flight path. This means that when the spray is directed from an atomizer near the center of the tube outwardly toward its wall, the droplets are deposited over a range of positions along its wall. Near the outer reaches of this spray pattern the rate of deposition is low compared to the rate of deposition in the center portion. In this "overspray region" furthest from the open end of the mold the rate of buildup is so slow that some of the material is, of necessity, left behind as the tube is pulled from the mold.

Singer (U.S. Pat. No. 3,670,400) and Sendzimir (U.S. Pat. No. 4,512,384) address this problem by providing for reciprocation of the mold, the same technique used in continuous casting processes. As in those processes, when the mold is advanced past the less rapidly moving deposit, some material is dragged off the mold by the deposit and builds upon the end of the deposit. In continuous casting processes, accretions such as these are welded to the deposit as the surrounding melt solidifies, or, if they are deflected away from the mold and into the melt, they can be remelted. The net effect is that their accretion does not seriously mar the integrity of the casting. With the spray deposition processes, however, there is no natural mechanism present to fuse the accretion smoothly to the deposit, or to remove them if they assume awkward attitudes. If an accreted mass of some size shadows part of the deposit surface from the spray, then a large void will be left in the tube wall. Similarly, protrusions on the inner surface produced by the accretion of large fragments will be subsequently built up at least as fast as the surrounding material, so they will result in the formation of irregular bumps or protrusions on the inner wall of the tube.

All of the shortcomings of the prior art, as discussed so far, are addressed in the present invention. This invention also makes possible the formation of tubular products of one metal lined with a second metal, and while such products have been produced in short lengths by techniques such as chemical, electrochemical, and vapor deposition means, as well as by plasma spray deposition to the inside of preformed pipes, none of the processes described above have been used to make such products. The advantages of producing such products by continuous casting techniques, as opposed to the deposition techniques just referred to, is that products so formed are more easily welded without destroying the coating in the vicinity of a joint. Composite tubes or pipes made by continuous casting can have inner or outer layers of corrosion resisting materials which are of substantial thickness and which are well bonded to the base metal making up the major portion of the pipe's volume. These protective layers can be welded before or after the base metal is welded. The joints so formed can have all the strength and corrosion resistance the composite pipe exhibits before it is welded. Preformed pipes which are coated by the known processes can not be satisfactorily joined by welding because the coatings are too thin to be separately welded. Furthermore, welding of the base metal destroys these coatings in the vicinity of the joint, with the result that the joint must then be recoated, a process which is generally impractical.

Composite pipes made up of two different metals are made routinely in industry by first forming a composite billet consisting of a thick-walled cylinder of one metal closely fitted inside a thick-wall cylinder made of the other metal. These two cylinders are joined at their ends by welding and then this billet is reduced to a pipe by standard metal working processes. Pipes made by this process can be satisfactorily welded, but they are not widely employed because they are costly to produce.

SUMMARY OF THE INVENTION

Among the many objects of the present invention are to provide an apparatus and process: to produce tubular shapes of fully-dense metals by a continuous casting process; to produce tubular shapes of the foregoing type having smoother inner and outer surfaces and which do not stick to the casting mold; to produce tubular shapes of the foregoing type without exposure to oxidation of the molten metal and of the cast tube; to produce tubular shapes of the foregoing type having uniform and rapidly-quenched microstructures; to produce tubular shapes of the foregoing type from alloys of many different compositions, and tubular shapes having different thicknesses of different compositions; to produce tubular shapes of the foregoing type having a laminate construction wherein the layers vary in thickness and composition of material; to produce tubular shapes of the foregoing type having a reinforcing material incorporated in its thickness; and to produce sheet materials with rapidly-quenched microstructures.

These and other objects of the invention are attained in an apparatus and process for the continuous casting of tubular metallic shapes by the incremental centrifugal deposition of molten metal on a mold. The molten metal from which the tubular shape is formed is centrifugally deposited adjacent to the outlet of a fluid-cooled mold by a nozzle assembly, with the metal being cooled and rapidly solidified by the mold to form a cylindrical shell upon which additional metal is deposited by the nozzle assembly to incrementally build the thickness of the tubular shape. The tubular shape being formed is withdrawn continuously from the mold, and is further cooled by coolant directed thereon exteriorly of the mold. The nozzle assembly may be provided with multiple orifices arranged along the longitudinal axis of the mold, in the direction of withdrawal of the tubular shape, with subsequent downstream orifices depositing additional molten material to increase the thickness of the tubular shape. Sealing means are provided to maintain an inert atmosphere, including means to seal the tubular shape, to prevent oxidation of the molten metal.

The nozzle assembly may be rotated to centrifugally discharge the molten metal or, alternatively, the mold may be rotated as the metal is discharged thereon by the stationary nozzle assembly, to centrifugally distribute the metal on the mold.

Single-layer tubular shapes, with or without a reinforcing material incorporated in its thickness, may be cast. By providing one or more different metals to selected different nozzle orifices, multiple-layer composite shapes may be produced having layers of different composition and thicknesses.

Tubular shapes cast according to the present invention may be longitudinally split and flattened to form sheet metal having rapidly-solidified, refined microstructures.

A better understanding and appreciation of the foregoing description as well as other objects, features and advantages of the invention can be obtained from the following description of presently-preferred embodiments, when considered in conjunction with the accompanying drawings.

FIGS. *4a–4c* illustrate different orifice configurations for the nozzle of the casting apparatus.

FIG. 5 shows, in cross section, another embodiment of the casting apparatus.

FIG. 6 is a graph showing the volumetric flow rate of molten tin through different size nozzle orifices as a function of the nozzle rotational speed.

FIG. 7 shows another embodiment of the casting apparatus of the present invention.

FIG. 8 shows, in cross section, another technique for sealing the atmosphere within the casting apparatus.

FIG. 9 schematically shows, partly in section, a modification of a casting apparatus particularly suitable for incorporating reinforcing fibers into the cast tube.

DETAILED DESCRIPTION OF THE PREFERRED EMBODIMENTS

Figure 1:
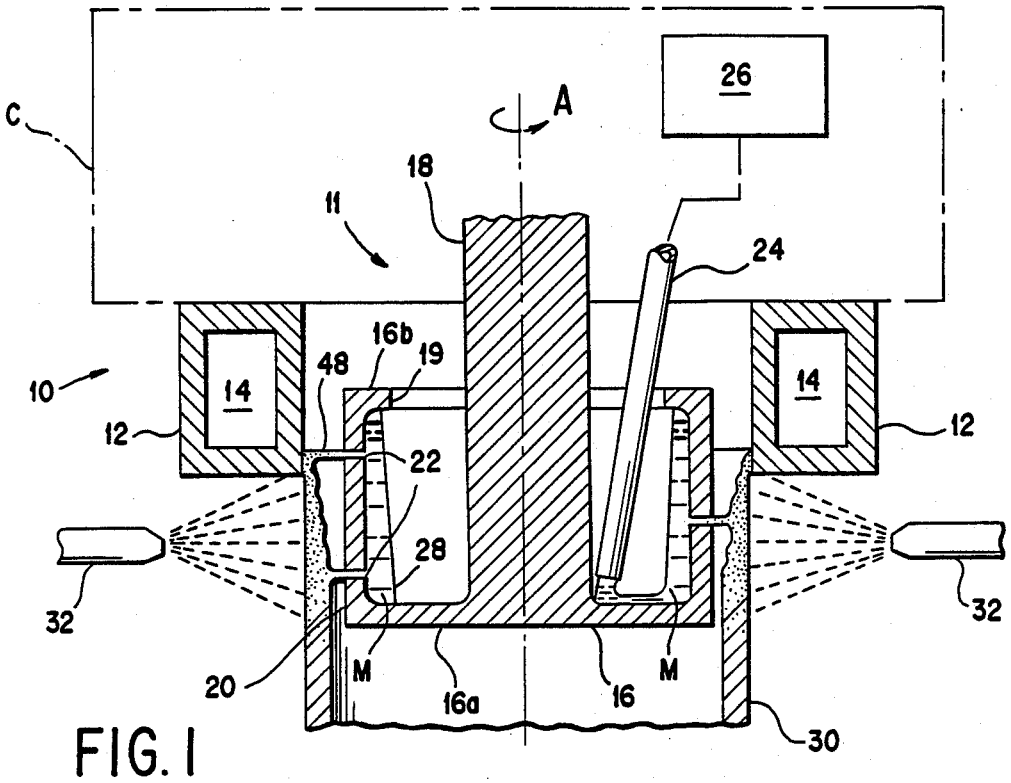
FIG. 1 schematically shows, partly in section, one embodiment of the tube casting apparatus according to the present invention.

Referring now to the drawings wherein similar reference characters refer to similar structural elements, FIG. 1 shows schematically one embodiment of a tube casting apparatus 10 of the present invention, in which a nozzle assembly, identified generally as 11, is positioned coaxially with and rotatable about the axis of a mold 12 having an interior passage 14 for the circulation of a coolant circulated therethrough by suitable means (not shown). Nozzle assembly 11 includes a hollow, cup-shaped head 16 attached at its closed end **16*a* to one end of a shaft 18 which is coupled to a suitable driving means (not shown) for rotation about the central axis of the shaft, as indicated by the arrow A. The other end 16*b* of nozzle head 16 has an opening 19 to accommodate shaft 18. The peripheral wall 20 of head 16 is provided with a plurality of orifices 22, three of which are shown in FIG. 1**.

Nozzle head 16 may have as many orifices as required, varying from a single orifice, to more than three. If a single orifice is used, it is preferably axially located in the portion of the peripheral wall 20 which is adjacent to the lower edge or mouth of the mold 12. If a plurality of orifices are used, the uppermost orifice, in the orientation of FIG. 1, is preferably axially located in the portion of wall 20 which is adjacent to the lower edge of mold 12, as shown in FIG. 1.

One end of a delivery pipe 24 extends into the interior of nozzle head 16 to discharge a molten metal, or melt, M toward the closed end 16*a* of the head, from a source 26. The free surface of the melt M assumes the shape of a paraboloidal section whose inner surface 28 is nearly vertical if the nozzle head 16 is rotated at a sufficiently high rate.

The outer surface of a cast tube 30 formed by operation of the casting apparatus 10, as described more fully below, is cooled by a spray of cooling fluid, such as provided by spray nozzles 32 located adjacent to the mouth of mold 12.

When the casting apparatus 10 is used with reactive metals, it is necessary to avoid oxidation of the molten metal during casting. This may be achieved by conducting the casting within the apparatus 10 which is evacuated of air and filled with an inert gas. To this end, mold 12 is affixed by a suitable gas-tight seal (not shown) to a chamber, shown schematically at C, within which the metal is melted at source 26 and provided to the delivery pipe 24. To seal the lower portion of apparatus 10 as it is being evacuated, nozzle assembly 11 may be enclosed within a starter pipe, as illustrated in FIG. 2.

Figure 2:
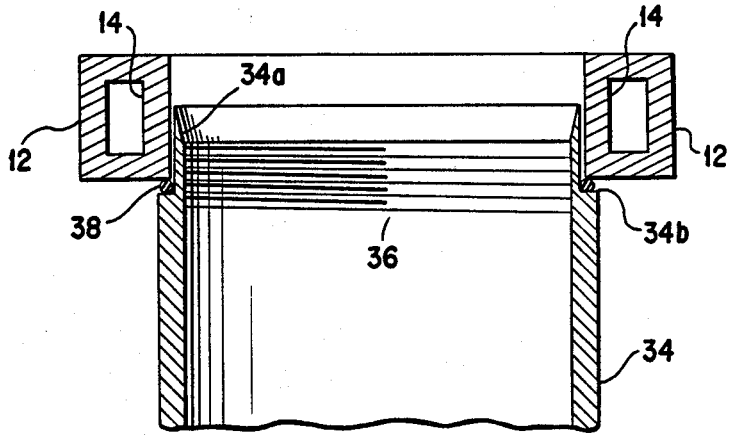
FIG. 2 shows, in cross section, a device used to start the casting process.

FIG. 2 shows, in schematic cross section, a starter pipe 34 having a reduced-diameter end portion 34*a* extending into mold 12. A shoulder 34*b* extends between the reduced-diameter portion 34*a* and the outer diameter of starter pipe 34. The inner surface of pipe portion 34*a* is roughened with shallow grooves 36, and the lower end (not shown) of starter pipe 34 is closed. A sealing ring 38 of elastic, resilient material, such as rubber or other suitable material, fits upon shoulder 34*b* and is pressed against the lower, inner peripheral edge of mold 12 to complete the seal. The chamber C and mold 12 are then evacuated, and an inert gas is introduced into the chamber and maintained at a pressure slightly higher than atmospheric pressure, preferably more than 0.01 psi and less than 1.0 psi above atmospheric pressure. When chamber C has been pressurized, the force holding the starter pipe 34 against mold 12 may be relaxed, after which a small flow of the inert gas between the starter pipe and the mold will prevent entry of oxygen into the casting apparatus 10 and chamber C. Once casting has begun, the continued flow of inert gas between the surface of cast tube 30 and the wall of mold 12 similarly prevents entry of oxygen.

Figure 3:
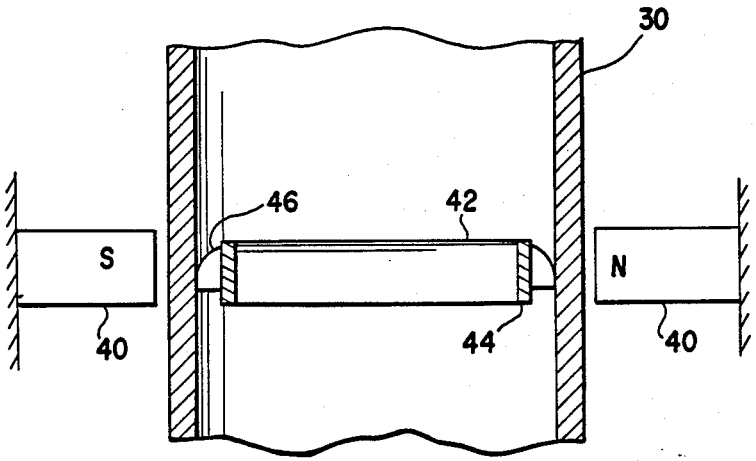
FIG. 3 shows, in cross section, a technique for sealing the atmosphere within the casting apparatus and the cast tube.

When tube 30 has been cast to a desired length, or when its length is such that is can not be easily pulled as a single, continuous piece, sections of tube are cut and removed. To prevent entry of oxygen and maintain the inert atmosphere within chamber C and casting apparatus 10 when tube 30 is cut, FIG. 3 illustrates means which are suitable for maintaining the inert atmosphere and is particularly suitable for non-ferromagnetic tubes. FIG. 3 shows a section of cast tube 30 located beyond the spray nozzles 32 in FIG. 1. At this location are situated a plurality of magnets 40, preferably electromagnets, fixedly arranged radially around the perimeter of tube 30. Within tube 30 is a diaphragm 42 supported by a tubular ring 44, constructed of a magnetic material, which is acted upon and supported by the magnets 40. To diaphragm 42 is affixed a circular gasket 46 of elastic material, such as rubber, which bears lightly upon the inner surface of tube 30. Diaphragm 42 is initially positioned within the starter pipe 34 and provisions, not shown, are made for evacuating behind it when the casting apparatus 10 and chamber C are evacuated. When chamber C is filled with inert gas, this gas seeps past gasket 46, and fills the space behind it within starter pipe 34. When starter pipe 34 is pulled out of mold 12, bearing the newly-cast tubing behind it, diaphragm 46 remains in place, creating a seal between the inert atmosphere in chamber C and apparatus 10 and the inside of the tubing beyond it. When a length of tube 30 is cut off beyond diaphragm 46, oxygen will come up to the diaphragm but, because of the pressure within chamber C, inert gas will seep past gasket 46 and prevent the entry of oxygen into the apparatus.

When casting tubes of ferromagnetic material, other means for supporting diaphragm 42 are required, as described later.

To initiate the casting operation with the apparatus shown in FIGS. 1-3, the rotating nozzle assembly 11 is first heated to a temperature above the melting point of the metal to be cast. Heating may be achieved with any suitable means (not shown), such as by directing the plume of a plasma torch into nozzle head 16. The nozzle assembly 11 is then set into rotation and molten metal is directed into nozzle head 16 via the melt delivery pipe 24. Coolant is circulated through passage 14 of mold 12. The rate of rotation of the nozzle assembly must be high enough to generate a pressure on the molten metal at the entrances of the orifices 22 equivalent to several times the force of gravity, but not so high as to create unduly high stresses within the material of which nozzle assembly 11 is constructed. The pressure upon the molten metal at the opening of the orifice depends upon the rotational frequency f of nozzle assembly, the density $\rho$ of the melt, and upon the inner and outer radii of the molten metal, which are expressed as $r_o$ and r, respectively. The mathematical expression for this pressure p is $$p=2\pi^2\rho f^2(r^2-r_o^2)$$

It is generally preferred to operate apparatus 10 such that this pressure is more than one pound per square inch (psi) and less than 10 psi, but it may be desirable in some instances to exceed these bounds. Depending upon the geometry of the nozzle assembly and the density of the metal being cast, it is normally necessary to rotate the nozzle assembly at a rate of a few hundred of a few thousand revolutions per second in order to generate the required pressure.

Continuing with the description of the casting process, when melt begins to issue from the orifices 22 the individual streams are deposited on the inner surface of the starter pipe 34, on the shallow grooves 36, casting the solidified metal to adhere to the starter pipe, which is then pulled from the mold 12 at a constant rate. By pulling the tube 30 at a constant rate and casting the metal at a constnt rate, a tube of any length can be produced.

The metallostatic head produced by the centrifugal force of the rotating nozzle assembly 11 causes the metal M to issue from the orifices 22. Melt issuing from the uppermost orifice forms a stream 48 which is deposited on the inner surface of mold 12 and solidified so that as the nozzle assembly 11 rotates, a ribbon of solidifed metal is formed in a helical configuration as the tube 30, of which this helix constitutes the outer surface, is withdrawn from the mold. The rate of withdrawal of tube 30 is such that the tube advances a large fraction of the ribbon width during each period of revolution of the nozzle assembly 11, so that the helical ribbon is made to sequentially overlap a portion of each previously deposited turn of the helix.

The nozzle assembly 11 may be configured with a single orifice in the uppermost position or with multiple orifices. If there is a single orifice at the uppermost level, then the nozzle assembly 11 makes a full revolution before new melt is caused to partially overlap the melt previously deposited on the mold wall. But if there is more than one orifice at the uppermost level, then the nozzle assembly 11 will complete only a portion of a revolution before new melt is deposited in a manner so as to partially overlap that last deposited on the mold wall.

In either event, as the melt is deposited its kinetic energy causes it to be spread out into a thin ribbon over a portion of mold 12 and some of its overlaps the last deposited metal. The melt which is deposited on the mold is chilled by the mold and is rapidly solidified, generally during only a small portion of the time it takes the nozzle assembly 11 to make one revolution. After the metal has solidified, it continues to cool by conduction of heat into the mold and this cooling causes it to shrink. The shrinkage causes a stress to develop, which soon parts the metal from the mold surface. That portion of the melt which overlaps the previously-deposited metal is conduction cooled by it and welded to it. The thermal contraction which causes the deposited metal to part from the mold results in the formation of a thin cylinder which is slightly smaller in diameter than the mold, the difference in diameter depending upon the coefficient of expansion of the metal being cast and upon the amount which it cools before exiting from the mold.

This same contraction process occurs during all continuous casting operations but, with those processes which have molten metal remaining in contact with the first-formed solid, molten metal continuously seeps between the just-solidified shell and the mold, causing the solidifying ingot to stick to the mold. With the incremental deposition process herein described, a very small portion of the melt deposited during each revolution penetrates under the metal most recently deposited, but this small bit of metal also parts freely from the mold as it cools. Since the outer diameter of the tube is uniformly smaller than the mold, it slides freely from the mold with no detectable sticking. For this reason there is no wear of the mold surface, the cast tube is of constant diameter and its outer surface is remarkably smooth.

The thin shell built up by the metal solidified on the mold wall forms the surface upon which melt from the next lower orifice or orifices is deposited. This process continues sequentially, building up the thickness of the tube wall incrementally to its fully desired thickness. The rotating nozzle assembly is normally situated such that only the melt streams issuing from the top one or two orifices are deposited within the cooled mold. Melt issuing from the lower orifices is deposited on the inner surface of the cast tube 30, beyond the mouth of the mold 12, and the heat content of this melt is removed through the outer surface of the tube which is cooled by fluid from spray nozzles 32.

Because the orifices 22 can be arranged about the perimeter of the nozzle head 16 in a desired fashion, and their number, size, and shape can all be varied, unprecedented control over the manner of deposition of melt is possible. This control, and the fact that the melt strikes the inner surface of the mold, and of the formed tube, as continuous streams of constant geometry, make it possible to achieve fully-dense microstructures with fine and uniform structures. By varying the size and position of the orifices, it is possible, for example, to alter the rate of deposition such that less melt is supplied to thicker portions of the tube so that the lower rate of heat transport to the chilled surface in the thick section, as compared to the thin section, does not lead to lower rates of freezing and cooling, with their frequently associated deleterious effects on the properties of the tube material. Conversely, if less rapidly cooled structures or higher rates of deposition are desired, these can be readily achieved by employing larger or more closely spaced orifices.

FIGS. 4*a*, 4*b* and 4*c* illustrate embodiments of the nozzle assembly 11 wherein the orifices 22 are arranged spirally around a portion of sidewall 20. The number of the orifices, the size of each orifice, variations of the sizes and spacing of the orifices, both circumferentially around the periphery of nozzle head 16 and axially relative to the centerline of shaft 18, may all be changed as required, as noted above.

The description of the invention has thus far been directed to the casting of tubes consisting of a single material. FIG. 5 shows, in schematic cross section, an alternative embodiment of the casting apparatus with which composite tubes can be cast, with a "100"-series reference characters used to identify the structural elements. Casting apparatus 110 has a nozzle assembly 111 rotatably disposed within a cooled mold 112 similar to the arrangement of FIG. 1. Nozzle assembly 111 has a nozzle head 116 provided with two chambers which individually distributes molten metal respective sets of orifices. Nozzle head 116 is attached to a drive shaft 118 at its lower end. An upper chamber 150 is supplied with a first molten metal (not shown) by a melt delivery pipe 124. This melt is caused by centrifugal force of the spinning nozzle to exit from a plurality of orifices 122 provided in the wall 150*a* of chamber 150.

Concentric with chamber 150 is a lower chamber 152 into which a second molten metal (not shown) is introduced by a melt delivery pipe 125 via a cylindrical duct 154 disposed concentrically relative to shaft 118 and chambers 150, 152. Molten metal emerging from duct 154 is caused by centrifugal force to distribute itself around the inner periphery of chamber 152, from which it flows through a plurality of orifices 123 in chamber wall 152*a*.

Due to its length, nozzle assembly 111 may be unstable without some means for reinforcement. One or more reinforcing spans 156 is provided which may or may not completely encircle shaft 118. If span 156 completely encircles drive shaft 118, then it may be penetrated by openings 158 which permit melt in duct 154 to enter lower chamber 152. It will be apparent to those skilled in the art that similar reinforcing spans, not shown, may be used to reinforce and stabilize the outer walls 150*a*, 152*a*, respectively, of chambers 150 and 152.

The nozzle assembly 111 of FIG. 5 is depicted as being constructed in a single piece, but it will be evident that construction will be simplified by fabricating the device from two or more pieces and joining them into an assembly which will provide the functions described in connection with FIG. 5.

Although not specifically described for apparatus 110 nor shown in FIG. 5, the oxygen-entry prevention means, starter pipe, fluid seals and means for maintaining an inert atmosphere provided for casting apparatus 10 are also incorporated into casting apparatus 110.

The apparatus of FIG. 5 can be used to produce composite tubes, such as tube 130 of one metal or alloy having a lining 131 of a separate metal or alloy formed therein, with many desirable features. The relative thicknesses of the respective layers in the tube can be readily adjusted. Because of this feature, special properties such as enhanced corrosion or wear resistance can be selectively provided on either the inner or the outer surface of the tube. The materials of the layers chosen to achieve these diverse objectives can be selected from a very wide range of alloy compositions. The materials can be similar, as when both are based on the same metal, such as aluminum, or they can be substantially different, such as having one layer be an alloy based on iron or nickel and having the other layer be an alloy based on aluminum or copper. Due to the efficient method of heat extraction employed, normally incompatible metals, such as iron and aluminum, may be used in combination, though care must be exercised in depositing the higher-melting temperature metals, such as iron, within the lower-melting temperature metals, such as aluminum. The most significant restraint on the selection of metals to be employed is that they must be compatible with the materials from which the nozzle assembly is constructed. Thus, very reactive metals such as titanium would be difficult to cast.

In the foregoing description, the casting apparatuses have been considered in a vertical position, but they can be arranged horizontally or even in an inclined orientation, since the centrifugal forces produced by the rotational action can be large compared to the force of gravity.

As noted earlier the pressure acting on the melt and causing it to exit from an orifice is $p=2\pi^2\rho f^2(r^2-r_o^2)$. if the nozzle assembly is oriented in a horizontal position, then the force of gravity causes a pressure gradient within the melt, and this pressure gradient acts in concert with the rotational pressure when an orifice is at the bottom of its orbit, and the two pressures are opposed when the orifice is at the top of its orbit. The gravitational pressure is equal to $\rho g(r-r_o)$ when the orifice is directed down and is equal to $\rho g(r_o-r)$ when the orifice is directed up. In these expressions $\rho$, r, and $r_o$ have the meanings given earlier, and g is the acceleration due to gravity.

The volume of metal exiting from a simple circular orifice in the preferred range of operating conditions (see Example 1 below) is proportional to the velocity of the melt stream leaving the orifice, which in turn is proportional to the square root of the melt pressure at the orifice. For these reasons the ratio of thickness of the top of the tube to that of the bottom of the tube in the horizontal attitude is proportional to the rartio of the upward velocity $V_u$ to the downward velocity $V_d$, and this ratio is expressed as:

$$\frac{V_u}{V_d} = \left[\frac{2\pi^2\rho f^2(r^2 - r_0^2) + \rho g(r - r_0)}{2\pi^2\rho f^2(r^2 - r_0^2) + \rho g(r_0 - r)}\right]^{\frac{1}{2}}$$

It can be seen from this expression that the density term cancels out, so for all metals the ratio of the tube wall thickness on its upper and lower portions depends only on the rotational frequency and the radii r and $r_o$.

For typical operating conditions, such as those described in Example 1 below, the rotational pressure is approximately 50 times as great as the gravitational pressure, so the lower and upper tube wall thickness are in the ratio $$\left[\frac{1 + 0.02}{1 - 0.02}\right]^{\frac{1}{2}} \approx 1.02$$

The tube will thus have thickness variations of only about two percent, a variation which is well within industrial standards for tubes and pipes. Thus, the disclosed apparatuses can be operated vertically or horizontally, with the latter simplifying problems associated with handling the tube produced.

The invention will be further described by the following illustrative examples.

EXAMPLE 1

A series of theoretical calculations have been carried out to determine the proper operating conditions for the apparatus of FIG. 1. These calculations determine, among other things, the rate at which liquid metal will be discharged from circular orifices of constant cross section located on the periphery of a rotating nozzle, such as that illustrated in FIG. 1. It is understood, of course, that the orifices in the apparatuses may be other than circular in configuration and be of non-uniform cross section.

The calculations employ the well known Bernoulli equation to calculate the velocity of fluid flow through an orifice. For a horizontal orifice, neglecting pressure gradients due to gravity, this equation has the form $$\left[\frac{\rho_2 - \rho_1}{\rho}\right] + \left[\frac{V_2^{-2}}{2\beta_2} - \frac{V_1^{-2}}{2\beta_1}\right] + E_f = 0$$

where $p_2-p_1$ is the pressure differential across the orifice, p is the fluid density, $\bar{v}$, is the average velocity of the bulk fluid approaching the orifice, $\bar{v}_2$ is the average velocity of the fluid exiting from the orifice, $\beta_1$ and $\beta_2$ are coefficients whose values, normally between 0.1 and 1, depend on the amount of turbulence in the flow, and $E_f$ is the entrance loss coefficient, whose value depends upon the entrance geometry of the orifice. Since the pressure at the outlet of the orifice is equal to that inside the nozzle assembly, $(p_2-p_1)$ is equal to p, given earlier as $2\pi^2\rho f^2(r^2-r_o^2)$. With the geometry employed in FIG. 1, $\bar{v}$, can be safely ignored in comparison with $\bar{v}_2$, and by making some reasonable assumptions about $\beta_2$ and $E_f$, the Bernoulli equation can be solved.

Calculations made in this manner have predicted, among other things, the volumetric flow rate through an orifice. The results of an example calculations are shown in FIG. 6. This graph shows the flow rate (cc/min.) of molten tin from different diameter orifices (D) on the permieter of a nozzle assembly having a six centimeter radius, as a function of the rotational velocity, with the nozzle assembly containing molten tin to a depth of 1 cm at the position of the orifice. It can be seen from the graph that significant amounts of metal can be processed. For example, with a rotational speed of 1000 RPM, the rate of flow through a single 0.1 cm diameter orifice is about 150 cc per minute. This corresponds to a rate of about 52 kg per hour from a single-orifice nozzle, and a continuous casting apparatus would normally have many orifices of such size or larger. Thus a continuous casting apparatus with twenty orifices of 0.1 cm diameter would deposit approximately one metric ton per hour, and this is certainly not the upper limit of the apparatus or the process.

EXAMPLE 2

Tin, a metal which can be readily cast in air without severe oxidation problems, was cast in a continuous fashion by the apparatus and process of FIG. 1. The metal was melted in a graphite crucible and heated to a temperature of 285° C. It was poured at a nearly continuous rate into a shallow, rotating nozzle assembly of the type illustrated in FIG. 1. The nozzle assembly, made of stainless steel, was 10 cm in diameter and approximately 1 cm deep, preheated to 300° C. by a resistance heater positioned above it, and was rotated at a speed of 1000 to 1200 RPM. The melt exited through one or two orifices of 0.1 cm diameter and was deposited within a water cooled naval brass mold with an inner diameter of 11.4 cm.

The casting process was initiated using a stater pipe of the type shown in FIG. 2. This pipe had an inner diameter of 11.0 cm and an outer diameter of 11.3 cm, and was scored on its inner surface with grooves approximately 0.05 cm deep. As melt began to issue from the nozzle, it struck the inner surface of the starter pipe and spread out to form a narrow ribbon around the circumference. The stater pipe was then lowered at constant rates, ranging from 0.5 to 2.0 cm per second, by a hydraulic tensile testing machine. Individual ribbon-shaped tracks deposited in this way were approximately 0.2 cm wide and approximately 0.01 cm thick. With the nozzle assembly rotating at 1000 RPM the period of revolution was 0.06 sec., and with a pulling rate of 1 cm/sec the distance of advance of the tube was 0.06 cm, so that, using a single orifice, a major portion of the melt (about $\frac{2}{3}$) was deposited on the previously deposited metal, creating a total deposit approximately three melt layers thick. Pulling of the starter pipe caused this layer to be deposited along the surface of the tube being formed, and as the tapered edge of the starter moved beneath the level of the rotating orifice a free standing tube was cast.

Of the melt which created this tube, approximately $\frac{1}{3}$ was deposited on the inner surface of the mold and $\frac{2}{3}$ were deposited on the free standing tube. The melt deposited on the mold wall solidified quickly and parted cleanly, with no evidence of the tube sticking to the mold The tube exited from the mold with a smooth, pore-free surface marked with very shallow lines defining the spiral course of the molten metal. The inner surface was somewhat less smooth, exhibiting the undulations characteristic of the free surface of a casting, as well as the shallow shoulders marking the edges of the spiral ribbon.

Casting of tubes under similar conditions with one orifice, but with a pulling rate of 2 cm/sec, produced a tube with only about a $\frac{1}{3}$ overlap of the deposit, so that the final wall thickness was in some places equal to the thickness of the ribbon and in some places equal to that of two ribbons. Tubes pulled at 2 cm per second, but with two orifices at the same elevation, were very similar to those cast with one orifice and pulled at 1 cm per second.

Multiple-orifice casting was not performed with tin because the apparatus did not have provisions for introducing flushing gas between the cast tube and the mold wall, a provision which is necessary to prevent quench fluid from entering the mold and disrupting the process.

In the embodiments of the casting apparatus considered thus far, the mold remains stationary and the nozzle assemble rotates to discharge the molten material. FIG. 7 illustrates an embodiment of a casting apparatus 50 in which the mold rotates and the nozzle assembly remains stationary. A crucible 51, disposed within an enclosed containment vessel 52, has a tubular, elongated extension arm 54 passing through the central passage of a mold 56 rotatably positioned adjacent to the containment vessel, and rotated by means not shown. As shown, extension arm 54 extends beyond the mouth of mold 56, and a plurality of orifices 58 are provided on the lower surface of end portion **54*a* extending beyond the mouth of the mold 56. One or two of orifices 58 are located within the confines of mold 56, with the remaining orifices located beyond the mouth of the mold. Spray nozzles 60, located adjacent to the mouth of mold 56**, direct sprays of coolant onto a portion of the mold and the tube being cast.

A molten material 62 contained within crucible 51 is discharged through orifices 58 and solidifies to incrementally build up the wall thickness of tube 64. Driven rollers 66, which are canted on their axes, such as shown in Robert, U.S. Pat. No. 2,752,648, are located downstream from the mouth of mold 56, to support tube 64 and to rotate it at the same speed as mold 56. The traction forces generated by rollers 66 cause tube 64 to be withdrawn from mold 56 at a constant rate, or at a rate which can be varied by varying the angle of inclination of canted rollers 66. This feature is of particular advantage during the startup phase. It can also compensate for changes in the metal deposition rate by, for example, slowing the pulling rate if one or more of the orifices should become blocked. The reduction in thickness resulting from such an event can be sensed by a suitable detector, not shown, which measures the thickness of the tube by means of its transparency to X-radiation or by measurement of the time required for ultrasound to propagate through its wall and back to a transducer contacting the tube via a film of water.

In order to assure delivery of the melt at a constant rate and at a pressure sufficient to cause it to exit through orifices 58 at sufficient velocity, the upper portion of crucible 51 is closed so that its pressure can be maintained by suitable means (not shown) at a higher level than that of the containment vessel 52. By means of this pressurized delivery system, the melt can be charged to the same pressure range found desirable above, that is, normally not less than 1 nor more than 10 psi above atmospheric. To further assure a constant rate of feed, the crucible 51 can also be supplied with a melt level control system, not shown, such as disclosed by Marchant, U.S. Pat. No. 3,510,345. Use of these techniques assure that the melt feed rate is controlled within the same range as discussed above, and similar casting rates are achieved.

To prevent oxidation of the melt, the alloy melting system is contained within the containment vessel 52 which can be evacuated and filled with an inert gas. The rotating mold 56 is sealed to vessel 52 by a vacuum seal 68, which may be of the type sold by the Ferrofluidics Corporation, Nashau, N.H. During evacuation of the apparatus before starting casting of the tube, it is necessary to seal the starter pipe to the mold. This can be achieved with a seal such as that shown in FIG. 8.

FIG. 8 shows the end of rotating mold 56 into which is inserted a portion of a starter pipe 70 identical to starter pipe 34, FIG. 1. To ensure that the starter pipe 70 will feed uniformly through rollers 66, it is necessary that the starter pipe have the same outer diameter as the cast tube 64. A vacuum seal provides the fluid seal between the mouth of mold 56 and the outer surface of starter pipe 70. This seal consists of a split-ring retainer 72 clamped around the end of mold 56 by a split clamp 74, such as is available commercially from Vacuum Products Corporation, Hayward, Calif. Retainer 72 has a beveled portion 72*a* which presses an O-ring seal 76 against both the mouth of mold 56 and the starter tube 70. The vacuum seal assembly is removed after the apparatus is filled with an inert gas, and inert gas flowing through the gap between the mold and the starter pipe, or the cast tube prevents entry of oxygen into the mold.

During continuous casting the end of tube 64 (FIG. 7) can be sealed by a diaphragm of the type shown in FIG. 3, which can be retained in place by means of magnets as in FIG. 3 or by some other physical means. Since the melt exits from the delivery tube in fixed positions, support members (not shown) affixed to the diaphragm can run from the containment vessel 52, through the rotating mold 56 and along side the extension arm 54. Because the diaphragm should rotate with the tube to minimize friction, the support members should be attached to the diaphragm by means of a rotating bearing assembly, also not shown. This support arrangement for the diaphragm will permit the inside of the tube to be kept free of oxygen even when casting ferromagnetic alloys.

Continuous centrifugal casting provided by apparatus 50 offers many advantages over earlier processes. Principal among these is that the cast tube does not stick to the mold. For reasons discussed above relative to the casting apparatuses of FIGS. 1–5, the solidified melt parts naturally from the mold. In older continuous centrifugal casting processes, the charge of molten metal within the mold presses against the thin solidified shell, causing it to stick to the mold much more than does the strand in stationary mold continuous castings. This effect does not occur with the present invention because the molten melt, which causes this effect in the older processes, is introduced outside of the mold. This incremental deposition of the melt leads to all of the other processing advantages described above.

An additional advantage with the rotating mold configuration is that the centrifugal force causes the deposited melt to be spread uniformly across the inner surface of the tube, creating a smoother surface than is possible with the rotating nozzle assembly. Since the tube is rotated, it also is formed with a completely uniform cross section. In addition, the extension arm can be of small cross section so small-diameter tubes can be cast, though this diameter will be limited by the necessity for providing supplemental heating means, not shown, to heat the extension arm prior to casting.

Casting apparatus 50 lends itself easily to the casting of tubes consisting of two different alloys. This is accomplished by providing the apparatus with two sources of molten metal, each of which is provided with an extension arm protruding through the rotating mold. The arm bearing the metal from which the outer layer of the tube wall is to be formed has one or two orifices located within the mold and a sufficient number located beyond the mold to build the wall to its desired thickness. The extension arm providing the second melt has a series of orifices situated beyond the last orifice which deposits the first metal. It is a simple matter to generate tubes with three or more layers by providing the appropriate array of orifices in the two extension arms. By this means one can readily fabricate base alloy pipe with corrosion resisting alloy layers on both its inner and outer surfaces.

The casting apparatus 10 of FIG. 1 can be readily adapted for the production of reinforced tubes, as illustrated in FIG. 9. A casting apparatus 80, which is identical to casting apparatus 10, with chamber C and some other elements not shown to enhance the clarity of the Figure, includes a nozzle assembly 81 rotatably disposed coaxially within a fluid-cooled mold 82 and having a hollow, cup-shaped nozzle head 84 secured to one end of a shaft 86 coupled to a rotating means (not shown). Molten material from which tube 88 is cast is introduced into nozzle head 84 by a melt delivery pipe 90.

Reinforcing fibers 92, stored on reels 94 are passed between pairs of rolls 96 which are biased together, into the mold 82 for incorporation into the thickness of the cast tube 88.

Casting of the tube 88 with the apparatus 80 is started and carried out in the same manner as with apparatus 10 of FIG. 1. Rotation of nozzle assembly 81 discharges the melt through orifices, not shown in FIG. 9, against the lower, inner surface of the mouth of mold 82. Fibers 92 are introduced through mold 82, at the same speed as cast tube 88 is withdrawn, so that the melt is discharged against the fibers. Upon solidification of the melt, fibers 92 are integrally incorporated within the thickness of tube 88.

The fibers 92 may be any material suitable for the purpose for which they are being incorporated into the tube 88. Regulation of the rate at which the fibers are introduced into the mold may be achieved with any known means and techniques.

Although only two reels of fibers are shown in FIG. 9, any number of such reels may be provided. It is also within the comprehension of the invention that the reinforcing fibers may be provided in the form of a sleeve which is pre-formed for the size of tube to be cast, or which can be fabricated during the casting process with known equipment for braiding, knitting or otherwise fabricating textile articles.

The continuous cast tubes possible with the present invention may be split and rolled flat to produce sheet metal of a single material or alloy, or a laminated composite having different layers of different materials or alloys, and/or a reinforcing layer or layers of fibers. The casting apparatuses described above may be used directly to produce such sheets, with the processing conditions appropriately selected to yield rapid solidification of the molten material to produce a refined microstructure in the sheet. Sheet material one meter wide or more may be produced in a cost-effective manner.

Sheet material made by this invention can be made directly from the molten material so that it is cheaper than is possible with known processes involving solidifying the metal as powder or thin foil and then consolidating the powder or foil into bulk form. Heat extraction is optimized with the present casting apparatuses so that it is possible to generate sheets with desirable microstructure characteristic of rapidly-solidified metals.

Since subsequent reheating is not required, the initial microstructures can be maintained in the final product.

In the foregoing description, the nozzle assembly or the mold may be rotated circumferentially to centrifugally distribute the melt. However, both the nozzle assembly and the mold remain stationary relative to the longitudinal axis of the mold; there is no movement of either element longitudinally. This fixed longitudinal orientation ensures that the melt forming the outer surface of the cast tube contacts the mold adjacent to the outlet for rapid solidification to form a freestanding tubular shell onto which additional quantities of melt are deposited to form the desired tube thickness. Further cooling and solidification of the tube occurs outside the mold, with the use of the spray nozzles.

Although preferred embodiments of the present invention have been described, it is to be understood that modifications and variations may be made by those skilled in the art without departing from the spirit of the invention, and such modifications and variations are considered to be within the purview and scope of the invention as defined by the appended claims.

What is claimed is:

1. An apparatus for forming a continuous tubular metallic article from a molten metal comprising:

a mold having an interior passage with an outlet and cooled by a circulating heat transfer fluid;

a nozzle assembly for discharging the molten metal at a location in said interior passage adjacent to said outlet where the metal is rapidly cooled and solidified to form a tubular article, said nozzle assembly having a plurality of orifices through which said metal is discharged, at least one of said orifices directing a first quantity of molten metal toward said interior passage, and at least one other orifice directing a second quantity of molten metal downstream of and adjacent to said outlet where the second quantity of molten metal is disposed on the solidified first quantity of metal;

means for rotationally distributing the molten metal in said interior passage;

means for continuously withdrawing the tubular article from said mold; and means disposed adjacent to said mold outlet for directing a second heat transfer fluid onto the tubular article.

2. An apparatus as set forth in claim 1, wherein each succeeding orifice downstream of the first orifice directs molten metal onto the inner surface of the solidified quantity of metal from the first orifice to incrementally increase the thickness of the tubular article.

3. An apparatus as set forth in claim 2, wherein the means for rotationally distributing the molten metal comprises means to rotate said nozzle assembly to centrifugally direct the molten metal toward said interior passage, adjacent to said outlet.

4. An apparatus as set forth in claim 3, further comprising means to establish and maintain an inert atmosphere within said apparatus.

5. An apparatus as set forth in claim 3, wherein said means for directing a second heat transfer fluid includes nozzle means disposed adjacent to said outlet directing a flow of said fluid against the exterior surface of the tubular article.

6. An apparatus as set forth in claim 2, wherein said first quantity of molten metal is a first metal or alloy, and said second quantity of molten metal is a second metal or alloy different from said first metal or alloy.

7. An apparatus as set forth in claim 6, wherein:

a first plurality of orifices directs said first molten metal or alloy toward said interior passage, and a second plurality of orifices directs said second molten metal or alloy onto the solidified first molten metal or alloy, each of said first and said second plurality of orifices being sequentially disposed in the direction of withdrawal of said tubular article from said mold, with said second plurality of orifices located downstream of said first plurality of orifices.

8. An apparatus as set forth in claim 2, wherein the means for rotationally distributing the molten metal comprises means to rotate said mold to cause the molten metal to be centrifugally distributed around said interior passage, adjacent to said outlet.

9. An apparatus as set forth in claim 8, further comprising means to establish and maintain an inert atmosphere within said apparatus.

10. An apparatus as set forth in claim 8, wherein said means for directing a second heat transfer fluid includes nozzle means disposed adjacent to said outlet directing a flow of said fluid against the exterior surface of the tubular article.

11. An apparatus as set forth in claim 1, wherein the nozzle assembly has separate chambers for holding separate molten metals, each chamber having an orifice through which said metal is directed toward said interior passage, adjacent to said outlet of said mold.

12. An apparatus as set forth in claim 11, wherein said nozzle assembly is positioned relative to said mold passage such that a first chamber is located with its orifice directing a first molten metal toward said passage, adjacent to said outlet, where said first molten metal is rapidly solidified to form the outer layer of said tubular article, and a second chamber is disposed downstream of the first chamber with its orifice directing a second molten metal toward the inner surface of said outer layer.

13. An apparatus as set forth in claim 12, wherein each of said first and second chambers has a plurality of orifices, at least one of said orifices in said first chamber directs said first molten metal toward said interior passage, adjacent to said outlet, where said first molten metal is rapidly solidified to form the outer layer of said tubular article, and each succeeding orifice in said first chamber downstream of the first orifice directs said first molten metal onto the inner surface of the solidified outer layer to incrementally build a first thickness of said tubular article from said first metal, and the orifices of said second chamber direct said second molten metal onto the inner surface of said first thickness to incremmentally build a second thickness of said tubular article from said second metal.

14. An apparatus as set forth in claim 13, wherein said nozzle assembly comprises a plurality of chambers, each having a plurality of orifices for directing a separate molten metal toward said interior passage of said mold to incrementally build separate thicknesses of said article from separate metals.

15. An apparatus as set forth in claim 13, wherein the means for rotationally distributing said first and said second molten metals comprises means for rotating said nozzle assembly.

16. An apparatus as set forth in claim 13, wherein said means for directing a second heat transfer fluid includes nozzle means disposed adjacent to said outlet directing a flow of said fluid against the exterior surface of the tubular article.

17. An apparatus as set forth in claim 16, further comprising means to establish and maintain an inert atmosphere within said apparatus.

18. An apparatus as set forth in claim 17, wherein said means to establish and maintain an inert atmosphere within said apparatus include:

means for evacuating the atmosphere in said apparatus;

means for introducing an inert gas into said apparatus and maintaining said gas under pressure; and a fluid seal disposed within the open end of the cast tubular article to prevent entry of the atmosphere into said apparatus through said article.

19. An apparatus as set forth in claim 18, wherein said fluid seal includes:

a sealing means disposed within said tubular article and movable relative to said article; and means supporting said sealing means within said tubular article and permitting relative movement between the sealing means and the tubular article.

20. An apparatus as set forth in claim 19, wherein said sealing means includes a magnetically attractive element, and said support means includes a fixedly-disposed magnetic element coacting with said magnetically attractive element to suspend said sealing means within the tubular article.

21. An apparatus as set forth in claim 1, further comprising means for introducing a reinforcing fiber into said mold, said fiber being incorporated into said tubular article.

22. An apparatus for forming a continuous tubular metallic article from a molten metal comprising:

a mold having an interior passage with an outlet and cooled by a circulating heat transfer fluid;

means for discharging the molten metal at a location in said interior passage adjacent to said outlet where the metal is rapidly cooled and solidified;

means for rotationally distributing the molten metal in said interior passage;

means for continuously withdrawing the tubular article from said mold; and means disposed adjacent to said mold outlet for directing a second heat transfer fluid onto the tubular article, said means for discharging the molten metal includes a containment means for receiving the molten metal, first conduit means having one end coupled to said containment means and the other end extending through the interior passage of said mold, and at least one orifice provided on the end portion of said first conduit means extending through said passage, said orifice discharging the molten metal toward said passage, adjacent to the outlet of said mold, said first conduit means having a plurality of orifices for discharging the molten metal, arranged parallel to the longitudinal axis of said conduit means, with at least a first orifice located interiorly of the outlet of said mold to direct a quantity of molten metal toward the passage of said mold where the metal is cooled and rapidly solidified, and subsequent orifices each direct a quantity of molten metal onto the inner surface of the solidified quantity of metal from the first orifice to incrementally increase the thickness of the tubular article.

23. An apparatus as set forth in claim 22, further comprising:

a second containment means for receiving a second molten metal; and a second conduit means disposed substantially parallel with said first conduit means, and having one end coupled to said second containment means and the other end extending past said other end of said first conduit means, said second conduit means having at least one orifice disposed downstream of the last orifice of said first conduit means, said second conduit means directing a quantity of said second metal onto the inner surface of the solidified quantity of metal from the orifices of said first conduit means, to provide a layer of said second metal inside said tubular article.

24. An apparatus as set forth in claim 23, wherein the means for rotationally distributing the molten metal in said interior passage comprises means to rotate said mold to cause said molten metals to be centrifugally distributed.

25. A process for forming a continuous tubular metallic article from a molten metal comprising the steps of:

providing a mold having an interior passage with an outlet and cooled by a circulating heat transfer fluid;

discharging the molten metal through a nozzle assembly at a location in said interior passage adjacent to said outlet where the metal is rapidly cooled and solidified to form a tubular article, said nozzle assembly having a plurality of orifices, at least one of which directs a first quantity of molten metal toward said interior passage, and at least one other orifice directs a second quantity of metal downstream of and adjacent to said outlet where the second quantity of molten metal is disposed on the solidified first quantity of metal;

rotationally distributing the molten metal in said interior passage;

continuously withdrawing the tubular article from said mold; and further cooling the tubular article exteriorly of the mold as it is being withdrawn.

26. A process as defined in claim 25, wherein each succeeding orifice downstream of the first orifice directs molten metal onto the inner surface of the solidified quantity of metal from the first orifice to incrementally increase the thickness of the tubular article.

27. A process as defined in claim 26, further including:

providing a first molten metal or alloy to a first set of said plurality of orifices; and providing a second molten metal or alloy, different from said first metal or alloy, to a second set of said plurality of orifices, said second metal or alloy forming a thickness of the tubular article inside of the thickness of the first metal or alloy.

28. A process as defined in claim 26, further including establishing and maintaining an inert atmosphere during the casting process.

29. A process as defined in claim 28, including:

removing the ambient atmosphere;

introducing a pressurized inert gas; and providing a fluid seal which will permit a slight flow of the inert gas, thus preventing entry of the ambient atmosphere.

30. A process as defined in claim 26, wherein the molten metal is rotationally distributed by rotating the nozzle assembly relative to a stationary mold.

31. A process as defined in claim 26, wherein the molten metal is rotationally distributed by rotating the mold relative to a stationary nozzle assembly.

32. A process as defined in claim 27, wherein the molten metal is rotationally distributed by rotating the nozzle assembly relative to a stationary mold.

33. A process as defined in claim 27, wherein the molten metal is rotationally distributed by rotating the mold relative to a stationary nozzle assembly.

34. A process as defined in claim 25, wherein the molten metal is discharged by a nozzle assembly having separate chambers for holding separate molten metals, each chamber having an orifice through which the respective metal is directed toward said interior passage, adjacent to said outlet of the mold.

35. A process as defined in claim 34, wherein each of said first and second chambers has a plurality of orifices, at least one of said orifices in said first chamber directs the first molten metal toward said interior passage, adjacent to said outlet, where said first molten metal is rapidly solidified to form the outer layer of said tubular article, and each succeeding orifice in said first chamber downstream of the first orifice directs said first molten metal onto the inner surface of the solidified outer layer to incrementally build a first thickness of said tubular article from the first metal, and the orifices of said second chamber direct the second molten metal onto the inner surface of said first thickness to incrementally build a second thickness of said tubular article from the second metal.

36. A process as defined in claim 35, wherein the nozzle assembly has a plurality of chambers, each having a plurality of orifices for directing a separate molten metal toward said interior passage of the mold to incrementally build separate thicknesses of the tubular article from separate metals.

37. A process as defined in claim 25, further including providing a reinforcing material into said mold for incorporation into the tubular article.

38. A process as defined in claim 25, further including the steps of:

slitting the tubular article longitudinally; and flattening the slit article to form a sheet metal.

* * * * *